US007552975B2

(12) United States Patent
Maier et al.

(10) Patent No.: US 7,552,975 B2
(45) Date of Patent: Jun. 30, 2009

(54) BACKREST ATTACHMENT DEVICE

(75) Inventors: Klaus Maier, Dachsberg (DE); Kurt Buntru, Stuehlingen/Eberfingen (DE)

(73) Assignee: Sedus Stoll AG, Waldshut (DE)

( * ) Notice: Subject to any disclaimer, the term of this patent is extended or adjusted under 35 U.S.C. 154(b) by 0 days.

(21) Appl. No.: 11/737,396

(22) Filed: Apr. 19, 2007

(65) Prior Publication Data

US 2008/0036267 A1 Feb. 14, 2008

(30) Foreign Application Priority Data

Apr. 24, 2006 (DE) ..... 10 2006 018 951

(51) Int. Cl.
*A47C 7/02* (2006.01)

(52) U.S. Cl. ..... 297/448.2; 297/440.16; 297/440.2; 297/440.21; 297/446.1; 297/446.2; 297/447.3; 297/447.4

(58) Field of Classification Search ..... 297/440.15, 297/440.16, 440.2, 440.21, 446.1, 446.2, 297/447.3, 447.4, 448.2
See application file for complete search history.

(56) References Cited

U.S. PATENT DOCUMENTS

| | | | | | |
|---|---|---|---|---|---|
| 2,709,484 | A | * | 5/1955 | Lamb | 297/446.2 X |
| 2,825,394 | A | | 3/1958 | Hamilton et al. | |
| 2,847,062 | A | * | 8/1958 | Henrikson et al. | 297/440.21 |
| 3,266,843 | A | * | 8/1966 | Feder | 297/440.16 |
| 3,724,897 | A | * | 4/1973 | Faiks et al. | 297/447.3 |
| 4,305,617 | A | * | 12/1981 | Benoit | 297/448.2 |
| 4,790,594 | A | * | 12/1988 | Temos | 297/440.21 X |
| 5,123,702 | A | * | 6/1992 | Caruso | 297/440.21 |
| 5,626,394 | A | * | 5/1997 | Perry | 297/448.2 |
| 5,806,931 | A | * | 9/1998 | Kogai | 297/452.2 X |
| 5,961,184 | A | * | 10/1999 | Balderi et al. | 297/440.21 X |
| 6,003,948 | A | * | 12/1999 | Holbrook | 297/446.1 X |
| 6,116,692 | A | * | 9/2000 | Tarnay et al. | 297/440.2 |
| 6,634,717 | B2 | * | 10/2003 | Kown | 297/446.2 |
| 7,429,084 | B2 | * | 9/2008 | Diedrich | 297/440.16 |
| 2003/0062756 | A1 | | 4/2003 | Ballendat | |
| 2003/0127897 | A1 | | 7/2003 | Wild | |

FOREIGN PATENT DOCUMENTS

| | | |
|---|---|---|
| DE | 38 27 057 A1 | 2/1990 |
| DE | 101 48 645 A1 | 4/2003 |
| DE | 102 00 358 A1 | 7/2003 |

* cited by examiner

*Primary Examiner*—Rodney B White
(74) *Attorney, Agent, or Firm*—Oblon, Spivak, McClelland, Maier & Neustadt, P.C.

(57) ABSTRACT

A backrest attachment device for a chair is disclosed and includes a metal bow with two bends that is designed such that a shorter intermediate piece with a 90° bend is connected to a comparatively long flank, the shorter intermediate piece in turn having connected thereto a shorter end piece with a 90° bend, wherein an intended level formed by the long flank and the intermediate piece and an intended level formed by the intermediate piece and the end piece are perpendicular to each other, and wherein the metal bow is insertable with a long flank portion thereof through an elongated hole introduced into the backrest frame and interlocked with a simple rotary motion in an interlocking mechanism within the backrest frame, and wherein the end piece of the metal bow is connectable to the frame of the chair.

4 Claims, 4 Drawing Sheets

BACKREST ATTACHMENT DEVICE

TECHNICAL FIELD

The present invention relates to the field of the furniture industry. It pertains to a backrest attachment device for a chair, wherein the chair has a seat and a backrest that are separated and arranged separately on the chair, i.e., without an immediately direct connection between the backrest and the seat.

STATE OF THE ART

On the one hand, chairs are known in which the backrest and the seat are designed as a single piece and thereby connected to each other. A seat shell of this kind known from the prior art exhibits in the transition area between the backrest part and the seat part armrests extending forward substantially parallel to the seat part, on which armrests are installed pins extending downward on the backrest side, which pins can be mounted by means of fasteners, e.g., screws, in a tubular frame. The tubular frame can be designed thereby so as to form either cantilever or four-legged chairs. Also known are chairs with a frame onto which a one-piece support mat forming the seat and the backrest is clamped taut. However, the disadvantage of these types of chairs is that they provide only limited sitting comfort.

On the other hand, chairs are known in which the seat and backrest are separated. Thus, for example, DE 102 00 358 A1 describes an office chair in which a seat is mounted on a seat support. Also mounted on the seat support is a backrest support extending substantially upward, on the upper end of which a backrest is attached. Armrests are not provided for this chair. DE 38 27 057 A1 describes an office chair having no backrest support in the region between the backrest and the seat part. The backrest support of this chair is formed by a bow with two substantially upwardly projecting arms that run parallel to one another and in each case to the side of the backrest and to the side of the seat part and onto which the backrest panel is attached. The armrests are attached on the one hand to the seat part and on the other hand to the backrest by means of threaded screws.

PRESENTATION OF THE INVENTION

The present invention attempts to eliminate the cited disadvantages of the prior art. It is the object of the invention to create a backrest attachment device for a chair in which the chair has a frame, preferably a metal frame; two armrests; a seat; and a backrest with a backrest frame, wherein the seat and the backrest are separated and arranged separately on the chair, i.e., without an immediately direct connection between the backrest and the seat, and a connection is achieved solely by means of the frame. This device is intended to be easy and inexpensive to manufacture, easy to assemble, and characterized by a high degree of stability.

According to the invention, this is achieved with a device comprising a metal bow with two bends that is designed such that a shorter intermediate piece with a 90° bend is connected to a comparatively long flank, the shorter intermediate piece in turn having connected to it a shorter end piece with a 90° bend, wherein the plane (also hereinafter referred to as an intended level) formed by the long flank and the intermediate piece and the plane formed by the intermediate piece and the end piece are perpendicular to each other, and the metal bow can be positioned with its long flank inserted through an elongated hole and positioned in the backrest frame and interlocked with a simple rotary motion in an interlocking device within the backrest frame, and wherein the end piece of the metal bow can be connected to the frame of the chair.

The advantage of the solution according to the invention consists in the fact that the backrest attachment can be manufactured easily and inexpensively. It can be easily installed from the outside and guarantees a sufficient degree of stability, although the backrest connection is achieved solely by means of the frame and not by means of the seat or a backrest support.

It is advantageous if the end piece of the metal bow can be inserted into a sheath arranged on the underside of an armrest and affixed there, and the armrest can be mounted on the frame of the chair. The attachment is achieved thereby preferably with the aid of screws. The upper portion of the elongated hole introduced into the backrest frame is advantageously concealed by the armrests, which improves the esthetic impression of the chair.

If the armrest with the sheath is molded by injection as one integral part made of plastic, the chair can be manufactured particularly inexpensively.

The backrest attachment according to the invention can be applied advantageously for cantilever chairs as well as four-legged chairs.

BRIEF DESCRIPTION OF THE DRAWING

An exemplary embodiment of the invention is depicted in the drawing. Shown are.

Only those elements essential for understanding the invention are shown. Identical elements are provided with identical reference numbers.

WAYS OF IMPLEMENTING THE INVENTION

The invention is explained in further detail below on the basis of an exemplary embodiment and FIGS. 1 through 5.

Figure 1:
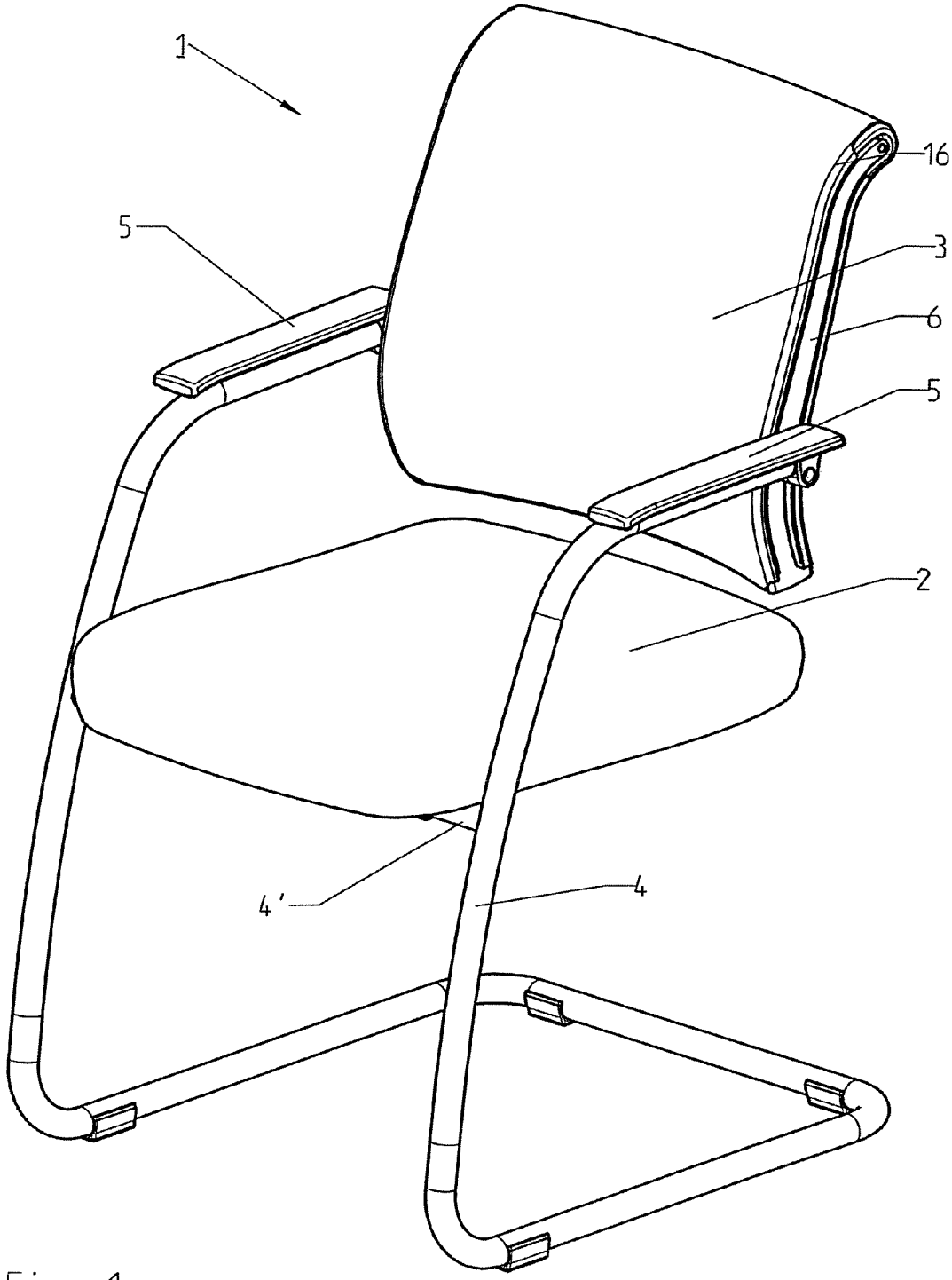
FIG. 1 a perspective view of a meeting chair designed as a cantilever chair with a built-in backrest attachment device according to the invention (not visible)
Figure 2:
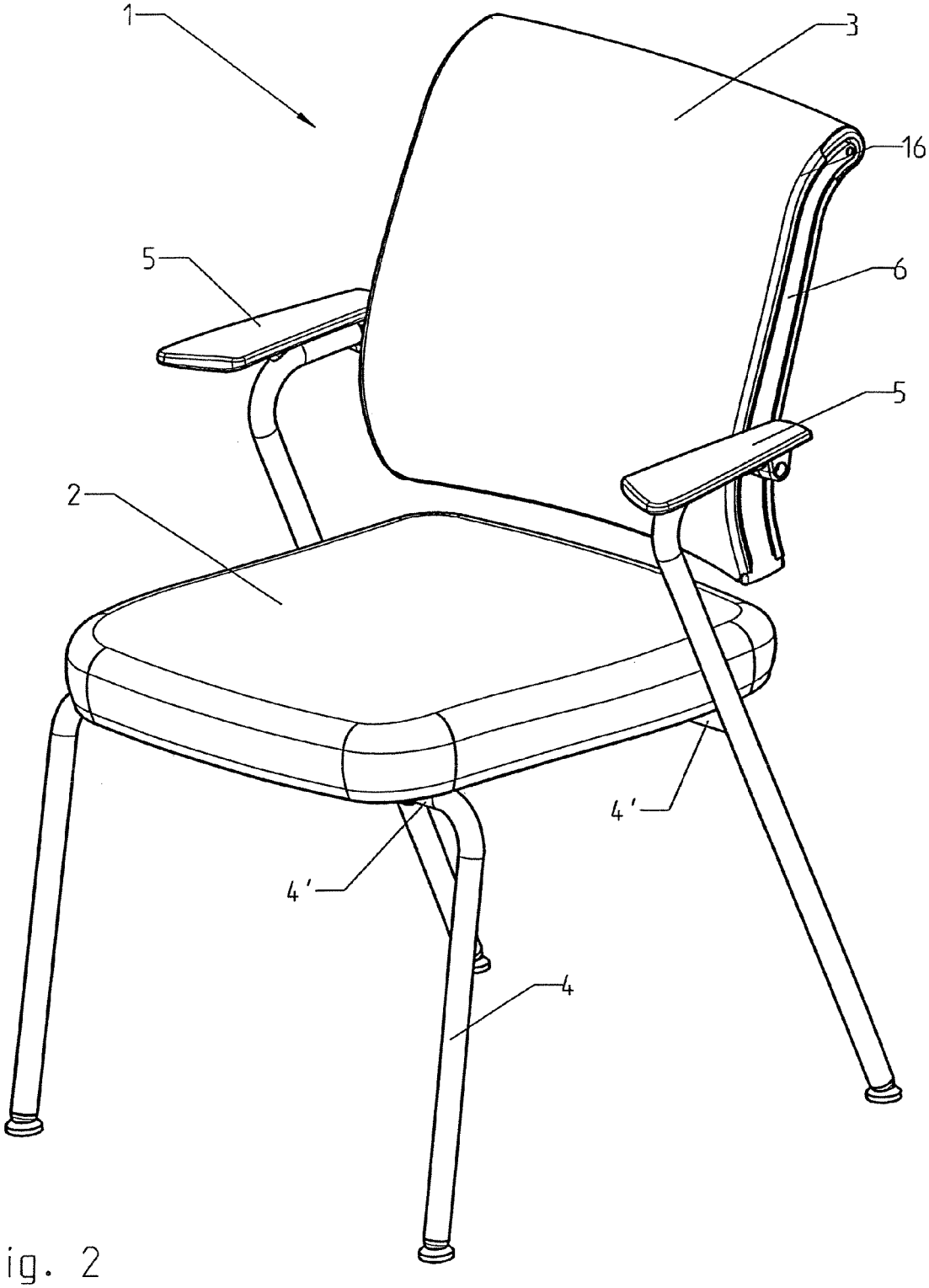
FIG. 2 a perspective view of a meeting chair designed as a four-legged chair with a built-in backrest attachment device according to the invention (not visible)

FIG. 1 and FIG. 2 each show a perspective view of a meeting chair 1 with a built-in backrest attachment device according to the invention—not visible in FIG. 1 and FIG. 2. FIG. 1 depicts a cantilever chair, and FIG. 2 depicts a four-legged chair. The device according to the invention can be used for both chair types.

The chair 1 comprises a seat 2, a backrest 3, a frame 4, two armrests 5, and the backrest attachment device not visible here. The frame 4 is preferably a metal frame, in particular, a tubular frame. The seat 2 is positioned on cross braces 4' of the frame 4, is preferably affixed thereon by means of screw couplings, and is thus supported by the frame 4. In the case of the cantilever chair (FIG. 1), only one front cross brace 4' is provided; in the case of the four-legged chair (FIG. 2), one front cross brace 4' and one rear cross brace 4' are provided. In this chair design, the seat 2 and the backrest 3 are configured separately and arranged separately from each other, i.e., without an immediately direct connection between them, on chair 1. The backrest 3, which comprises a backrest frame 6 and padding 16, is connected solely by means of the frame 4, namely on both side parts of the backrest frame 6. The backrest frame 6 is manufactured inexpensively out of plastic.

Figure 3:
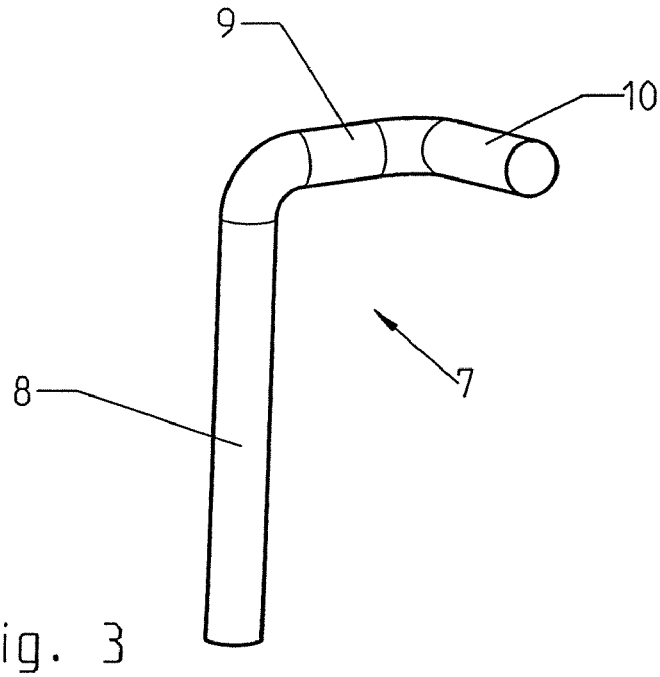
FIG. 3 a perspective view of the metal bow according to the invention.

FIG. 3 shows a perspective view of the metal bow 7 according to the invention. This metal bow has two bends and is designed such that a shorter intermediate piece 9 with a 90° bend is connected to a comparatively long flank 8, the shorter intermediate piece 9 in turn having connected to it a shorter end piece 10 with a 90° bend, wherein an intended level formed by the long flank 8 and the intermediate piece 9 and an intended level formed by the intermediate piece 9 and the end piece 10 are perpendicular to each other.

Figure 4:
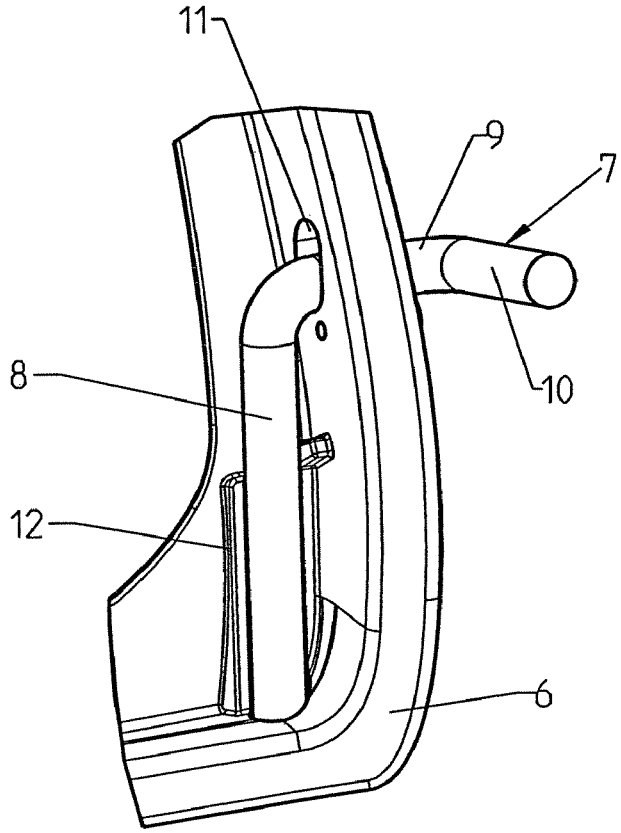
FIG. 4 a perspective view of the metal bow interlocked in the backrest frame and FIG. 5 an exploded view illustrating the assembly steps for the backrest attachment.

FIG. 4 shows a perspective view of the metal bow 7 interlocked in the backrest frame 6. The metal bow 7 is inserted with its long flank 8 into the backrest frame 6 through an elongated hole 11 introduced into the backrest frame 6 and is guided into an interlocking device 12 arranged on the inside of the backrest frame 6 and interlocked there with a simple rotary motion. In the interlocked state, the flank 8 extends vertically downward and is thus arranged substantially parallel to the side part of the backrest frame 6, whereas the intermediate piece 9 and the end piece 10 of the metal bow 7 are arranged perpendicularly thereto. The end piece 10 points forward in the direction of the seat 2 and is connected to the frame 4 of the chair 1, as can be seen in FIG. 5.

Figure 5:
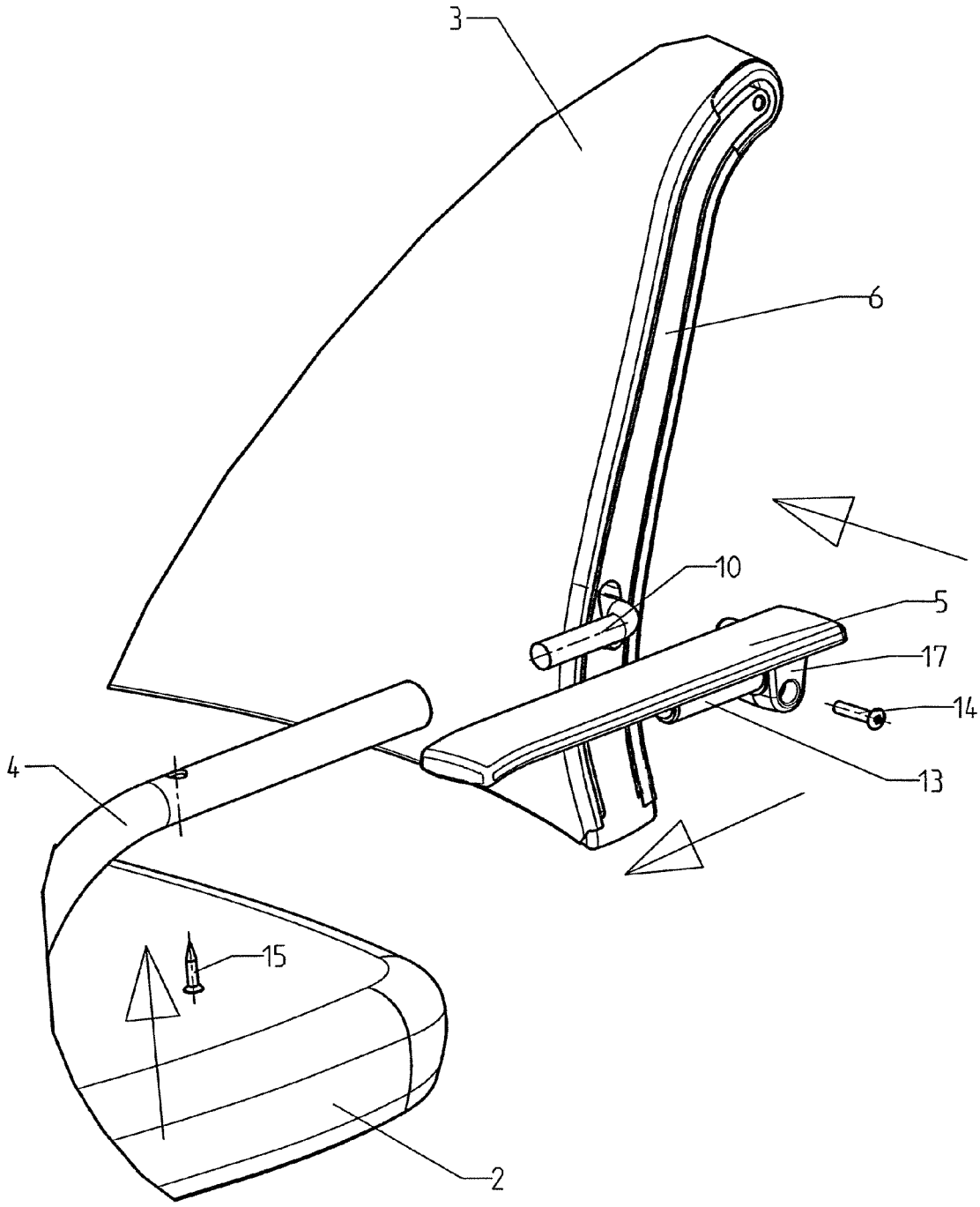

The additional individual steps for assembling the backrest attachment according to the invention are illustrated in the exploded view corresponding to FIG. 5. The end piece 10 of the metal bow 7 is inserted into a sheath 13 arranged on the underside of an armrest 5 and affixed with a screw 14, which is screwed into a receiving device 17 also arranged on the underside of the armrest 5. The back rest 3 is subsequently slid with the backrest attachment device and the arm rest 5 in the direction of the seat 2, the sheath 13 is slid into the frame 4, and the armrest 5 is mounted on the frame 4 of the chair 1. The attachment thereby is achieved preferably with the aid of a screw 15, which is screwed through the frame 4 into the armrest 5.

The armrest 5 attached in this way now advantageously conceals the upper part of the elongated hole 11 introduced into the backrest frame 6, thus imparting a favorable esthetic impression of the chair. The armrest 5 is designed advantageously as a single piece with the sheath 13 and the receiving device 17 for the screw 14 and, for example, is molded by injection as one integral part made of plastic. Thus, the chair can be manufactured particularly inexpensively.

The device according to the invention is easy to manufacture and to operate. It can be installed advantageously from the outside. Moreover, it is inexpensive. Although only a simple attachment of the backrest 3 is performed via the frame 4, a sufficient degree of stability is achieved.

Naturally, the invention is not restricted to the described example embodiment.

The invention claimed is:

1. A chair and backrest attachment device for the chair, which comprises:

a frame, two armrests, a seat, and a backrest with a backrest support having an elongated hole formed thereon, wherein the backrest is spaced apart from the seat and the seat and backrest are arranged on the chair without a direct connection therebetween, a metal bow with two bends and comprising a shorter intermediate piece with a 90° bend which is connected to a long flank that is longer than the shorter intermediate piece, the shorter intermediate piece in turn having connected to it a shorter end piece with a 90° bend, wherein a plane is formed by the long flank and the intermediate piece and another plane is formed by the shorter intermediate piece and the end piece, the planes being perpendicular to each other, wherein the metal bow is positionable with the long flank located within the backrest frame and the shorter intermediate piece extending through the elongated hole formed in the backrest frame, and an interlocking device positioned within the backrest frame with which said metal bow is interlocked, wherein the end piece of the metal bow is connectable to the frame of the chair.

2. A backrest attachment device according to claim 1, further comprising a sheath positioned on an underside portion of the armrest, wherein the end piece of the metal bow is insertable into said sheath and is affixed thereto, and where the armrest is mountable on the frame of the chair.

3. A backrest attachment device according to claim 2, further comprising screw fasteners configured for fixing said armrest to said backrest frame.

4. A backrest attachment device according to claim 3, wherein the armrest with the sheath and a receiving device for the fasteners are injection molded as an integral part and are made of plastic.

* * * * *